United States Patent [19]

Nill

[11] Patent Number: 4,659,957

[45] Date of Patent: Apr. 21, 1987

[54] METHOD OF MANUFACTURING AND ADJUSTING A COLOR PICTURE TUBE

[75] Inventor: Eberhard Nill, Oberesslingen, Fed. Rep. of Germany

[73] Assignee: ITT Industries, Inc., New York, N.Y.

[21] Appl. No.: 682,419

[22] Filed: Dec. 17, 1984

[30] Foreign Application Priority Data

Dec. 22, 1983 [DE] Fed. Rep. of Germany ..... 3346361

[51] Int. Cl.[4] ..... H01J 29/07; H01J 29/82; H01J 9/42

[52] U.S. Cl. ..... 313/402; 313/421; 445/4

[58] Field of Search ..... 313/402, 407, 421, 425, 313/427, 428; 315/368, 387; 445/3, 4, 30, 37

[56] References Cited

U.S. PATENT DOCUMENTS 4,160,935 7/1979 Groot et al. ..... 313/425 X
4,456,853 6/1984 Robinder et al. ..... 313/421

*Primary Examiner*—Moore, David K.
*Assistant Examiner*—K. Wieder
*Attorney, Agent, or Firm*—Donald J. Lenkszus

[57] ABSTRACT

A three electron gun color picture tube includes phosphorescent marks attached to the rear side fo the shadow mask. These marks can be used for checking the exact position of the electron beams during adjustment.

4 Claims, 2 Drawing Figures

METHOD OF MANUFACTURING AND ADJUSTING A COLOR PICTURE TUBE

BACKGROUND OF THE INVENTION

The invention relates to a color picture tube and to a method of attaching and adjusting a deflection unit to such a color picture tube.

Reproduction fidelity requirements of color picture tubes have increased considerably due to the frequent reproduction of graphics and texts. Above all, geometric distortions and convergence errors are effected. High fidelity reproduction is already achievable by employing self-convergent deflection systems and by taking diversified switching measures. It is possible to still further increase the fidelity of reproduction, when individual errors are compensated for. This, however, requires that such deviations can be detected as accurately as possible (during the first alignment and the servicing) and, if so required, also as often as possible (for making continuous corrections during operation).

SUMMARY OF THE INVENTION

It is an object of the invention to provide possibilities for detecting and correcting picture distortions.

This object is achieved by a three electron gun color picture tube which includes phosphorescent marks attached to the rear side of the shadow mark. These marks can be used for checking the exact position of the electron beams during adjustment.

BRIEF DESCRIPTION OF THE DRAWING

The invention will be better understood from a reading of the following detailed description in which.

DETAILED DESCRIPTION

Figure 1:
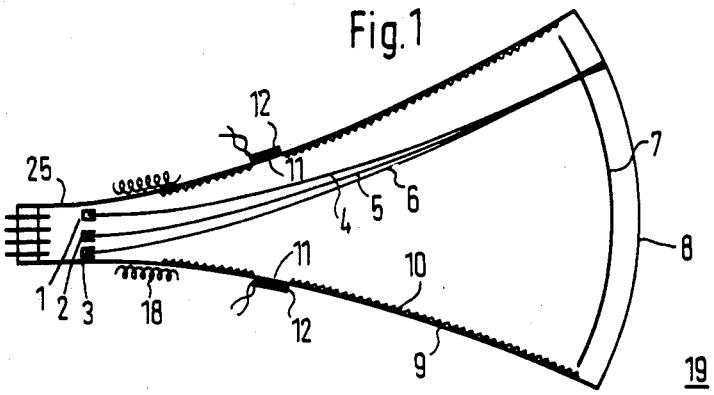
FIG. 1 is the sectional view taken through a color picture tube in accordance with the invention.

A color picture tube 19 according to the invention, shown in FIG. 1, includes a glass bulb 9, a screen 8, a (slit or) shadow mask 7, a glass tube neck 25, and three electron gun systems 1, 2, 3 disposed inside the neck of the tube. The inside of the glass bulb 9 is provided with a non-transparent interior coating 10. To the outside of the color picture tube 19, at the transition between the neck of the tube 25 and the glass bulb 9, a deflection unit 18 is mounted. Electron beams 4, 5, 6 are produced by the electron-gun systems 1, 2, 3, and deflected within the area of the deflection unit 18. These electron beams are supposed to intersect each other in the slits or holes of the shadow mask 7. A color picture tube according to the invention, in addition thereto, still comprises at least one opening 11 in the interior coating 10. At each opening 11 on the inside in the interior coating 10, a photosensitive element 12 is attached on the outside of the glass bulb 9 in such a way that light impinging upon the associated opening 11 is capable of being detected. This light comes from the shadow mask 7 which, in FIG. 1, is merely shown schematically.

Figure 2:
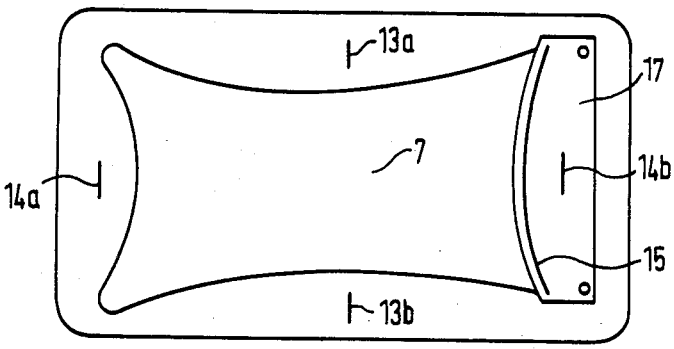
FIG. 2 schematically shows the shadow mask of a color picture tube according to the invention, in a rear view.

The alterations on the shadow mask 7, which are proposed by this invention, are further explained with reference to FIG. 2. This drawing shows the rear view of the shadow mask 7 of a color picture tube according to the invention. The shadow mask 7 is fixed on the front side of a holder 16, and the edges of the shadow mask 7 are covered on the rear side by the holder 16. Marks 13*a*, 13*b*, 14*a*, 14*b* are provided for which consist of such a material which, upon impingement of an electron beam, emits eithr visible or UV light. Preferably, the marks consist of phosphor strips. In the given example, the marks 13, 14 are attached to the holder 16 or to a mark support 17 disposed thereon. It is possible, however, to attach the marks in the inside area of the shadow mask 7 whenever it is desired to received return indications from there. When applying such marks, however, care has to be taken that the holes themselves remain free. It is also possible, to apply the marks directly to the shadow-mask 7 within the marginal range thereof which, however, may not be "shadowed" with respect to the electron beams 4, 5, 6 by the holder 16. Both, the kind of marks and the way in which they are applied, are chosen such that a certain correctable error becomes recognizable. The openings 11 in the interior coating 10 of the glass bulb 9 and the associated light-sensitive elements 12, however, are to be chosen such that from each of the light-sensitive elements the largest possible portion of the light emitted by the marks can be received, and that each flash of light emitted by any portion of a mark, is detectable by at least one of the light-sensitive elements 12. Whether a light-sensitive element 12 is to be attached firmly or only temporarily, for example, by applying a corresponding test head, depends on whether with the aid of the light as received by this particular light-sensitive element 12, alignment works are to be carried out only once, or whether checks are to be carried out at regular intervals.

The vertical marks 13*a*, *b*, 14*a*, *b*, are in such a way attached to the holder 16 or the mark support 17 that they will be hit by such electron beams whose imaginary extensions land on the four center portions of the edges of the screen. In this way, it is possible in particular to check the convergence in the centers of the four sides.

Normally, a color picture tube is written with a raster extending on all sides by a few percent beyond the screen edge and, consequently, also beyond the apertured portion of the shadow mask. The marks 13 and 14 serving the convergence correction, may also be outside this range, because during the adjustment (alignment) of the color picture tube there may also be written a larger raster pattern.

With a color picture tube comprising vertical marks 13*a*, *b*, 14*a*, *b* with which the convergence in the centers of the edges of the screen is capable of being checked, the proper seating of the deflection unit can also be controlled. This not only permits the deflection unit to be very well adjusted, but the adjusting process can also be extensively automated. Usually, a deflection unit 18 is attached and adjusted to a color picture tube 19 in such a way that the unit 18 is first of all preassembled. The color picture tube 19 is then put into operation with the preassembled deflection unit 18 in such a way that a raster pattern is written. Next, the deflection unit 18 is displaced in the longitudinal direction of the picture tube 19 in such a way that in the center of the picture, the electron beams 4, 5, 6 of the three electron-gun systems 1, 2, 3 converge. Then the deflection unit 18 is turned in such a way about a horizontal axis that the electron beams 4, 5, 6 will converge in the center of both the upper and the lower picture edges. After that, the deflection unit 18 is turned in such a way about a vertical axis that the electron beams, 4, 5, 6 will converge in the center of the right-hand and the left-hand picture edges. The convergence is detected by a test operator checking whether in the presence of only one single electron beam the associated color exists everywhere. If necessary, the process has to be repeated. After that, the deflection unit 18 is irremovably connected to the color picture tube 19. With a color picture tube according to the invention, this process can be modified in such a way that the raster pattern, at least during the convergence adjustment, is written so large at the edges of the picture, that the vertical marks 13*a, b,* 14*a, b* are written over by the raster pattern as well. The raster is not written by all electron-gun systems 1, 2, 3, at the same time, but only by one at a time. For checking purposes, it is sufficient to use two of the three electron-gun systems, preferably the two outer ones for the colors red and blue. Then, the times are measured which the electron beams take for extending from the left-hand picture edge to the respective mark 13*a, b,* 14*a, b.* An exact adjustment is achieved when all electron beams take the same time for extending from the left-hand picture edge to one definite mark. Depending on what electron beam lands earlier, and on how large the time difference is, the adjustment will have to be varied more or less in either the one or other direction.

What is claimed is:

1. A color picture tube comprising:

a glass bulb having a non-transparent interior coating;

three electron gun systems disposed in said glass bulb;

a screen closing one end of said glass bulb;

a shadow mask assembly disposed between said three electron gun systems and said screen;

at least four phosphor strip portions on said shadow mask assembly on the side thereof facing said three electron gun systems, each of said phosphor strip portions lying outside the range of the raster pattern of said picture tube during normal operation thereof, each of said phosphor strip portions transmitting light upon impingement by an electron beam extending beyond said normal raster pattern and each of said phosphor strip portions being associated with the center of a corresponding edge of said shadow mask assembly, a plurality of openings in said interior coating, each of said openings optically coupled with a corresponding one of said phosphor strips; and photo sensitive means outside said glass bulb for detecting light emitted from said phosphor strip portions through said plurality of openings whereby the correct mounting position of a deflection unit mounted on said picture tube may be determined.

2. A color picture tube in accordance with claim 1 wherein:

said shadow mask assembly comprises a shadow mask and a holder; and said at least four phosphor strip portions are attached to the edges of said shadow mask.

3. A picture tube in accordance with claim 1 wherein:

said shadow mask assembly comprises a shadow mask and a holder; and said at least four phosphor strip portions are attached to said shadow mask holder.

4. A method of attaching and adjusting a deflection unit to a color picture tube of a type comprising a glass bulb having a non-transparent interior coating, three electron guns diposed in said glass bulb, a screen closing one end of said glass bulb, a shadow mask assembly interposed between said screen and said three electron guns, phosphor strip portions on said shadow mask assembly and associated with the centers of each of four edges of said shadow mask assembly and in optical communication with photodetection means via openings in said interior coating, said phosphor strips lying outside the range of the raster pattern of said picture tube during normal operation, comprising the steps of:

preassembling said deflection unit;

placing said deflection unit on said picture tube;

jointly operating said deflection unit and said picture tube to generate a raster display which extends outside the range of the raster pattern during normal operation of said picture tube;

displacing said deflection unit in the longitudinal direction of said picture tube until electron beams of said three electron guns converge in the center of said screen said electron beams scanning to the edges of said shadow mask assembly;

turning said deflection unit about a horizontal axis such that said electron beams converge in the center of the upper and lower edge of said screen;

turning said deflection unit about a vertical axis such that said electron beams converge in the center of the side edges of said screen;

measuring the time differences for said electron beams to activate predetermined ones of said phosphor strip portions by utilizing said photodetectors to detect when said strip portions emit light;

evaluating said time differences as a measure of both the amount and kind of deviation from convergence;

irremovably connecting said deflection unit to said picture tube.

* * * * *